US007320465B2

(12) United States Patent
Seo et al.

(10) Patent No.: US 7,320,465 B2
(45) Date of Patent: Jan. 22, 2008

(54) PAPER FEEDING UNIT AND IMAGE FORMING APPARATUS USING THE SAME

(75) Inventors: In-sik Seo, Suwon-si (KR); Yong-whan Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 255 days.

(21) Appl. No.: 11/047,587

(22) Filed: Feb. 2, 2005

(65) Prior Publication Data

US 2005/0269760 A1 Dec. 8, 2005

(30) Foreign Application Priority Data

Jun. 7, 2004 (KR) ..... 10-2004-0041263

(51) Int. Cl.
*B65H 3/06* (2006.01)

(52) U.S. Cl. ..... 271/119; 271/121; 271/266; 271/273

(58) Field of Classification Search ..... 271/119, 271/121, 10.13, 273, 264, 272, 10.11, 125, 271/266
See application file for complete search history.

(56) References Cited

U.S. PATENT DOCUMENTS 4,589,650 A * 5/1986 Miyoshi ..... 271/242
5,681,036 A * 10/1997 Wakahara et al. ..... 271/10.12
6,520,497 B2 * 2/2003 Tamura ..... 271/122

FOREIGN PATENT DOCUMENTS

| | | |
|---|---|---|
| JP | 03-243555 | 10/1991 |
| JP | 06-314006 | 11/1994 |
| JP | 11-268849 | 10/1999 |
| JP | 2001-348134 | 12/2001 |
| JP | 2002-356238 | 12/2002 |

* cited by examiner

*Primary Examiner*—Patrick Mackey
*Assistant Examiner*—Kaitlin S Joerger
(74) *Attorney, Agent, or Firm*—Stanzione & Kim, LLP

(57) ABSTRACT

A paper feeding unit of an image forming apparatus, which includes: a pickup roller; a first feed roller to feed the paper in a required direction; and a reverse roller to prevent a plurality of sheets of paper from being fed by rotating in an opposite direction to the first feed roller and to separate the paper into individual sheets, wherein the first feed roller has a contact section in contact with the reverse roller and a non-contact section where the first feed roller is apart from the reverse roller and the first feed roller feeds the paper by making a one-time rotation and stops rotating with the non-contact section facing the reverse roller. Since the feed roller and the reverse roller are put apart from each other in a waiting mode, the rollers can be protected from abrasion and paper can be fed smoothly.

18 Claims, 2 Drawing Sheets

PAPER FEEDING UNIT AND IMAGE FORMING APPARATUS USING THE SAME

CROSS-REFERENCE TO RELATED APPLICATIONS

This application claims the benefit under 35 U.S.C. § 119 of Korean Patent Application No. 2004-41263 filed on Jun. 7, 2004, in the Korean Intellectual Property Office, the disclosure of which is incorporated herein in its entirety and by reference.

BACKGROUND OF THE INVENTION

1. Field of the Invention

The present general inventive concept relates to an image forming apparatus, and more particularly, to a paper feeding unit to supply paper to an image forming unit and an image forming apparatus using the paper feeding unit.

2. Description of the Related Art

As shown in FIG. 1, a conventional paper feeding unit of an image forming apparatus comprises a paper feeding cassette 1 to accommodate paper, a pickup roller 2 to pick up the paper in the paper feeding cassette 1, a first feed roller 3 to feed the picked-up paper, a reverse roller 4 to prevent the feeding of a plurality of sheets of paper in cooperation with the first feed roller 3, and second and third feed rollers 5 and 6 which are set up at a predetermined space behind the first feed roller 3.

The first feed roller 3 and the reverse roller 4 are brought into contact with each other to define a predetermined nip therebetween, and they have a rotation direction opposite to each other. Thus, if two pieces of paper are picked up by the pickup roller 2, one of them is fed by the first feed roller 3 in the normal way while the other piece of paper is sent back to the paper feeding cassette 1 by the reverse roller 4.

If an edge of the paper fed by the first feed roller 3 is inserted between the second feed rollers 5 in the paper feeding unit of the conventional image forming apparatus, power to the first feed roller 3 is cut off, and thus the first feed roller 3 becomes idle while the paper is fed by a feeding power of the second feed rollers 5.

Herein, since the reverse roller 4 and the first feed roller 3 are always in contact with each other at a predetermined level of pressure while the reverse roller 4 rotates in the opposite direction with respect to the first feed roller 3, the surfaces of the first feed roller 3 and/or the reverse roller 4 become worn out easily. The abrasion of the surfaces of the rollers is inevitable due to the structure of a conventional paper feeding unit. If the abrasion state is continued, significant noise may be generated. Therefore, the rollers should be replaced with new ones when they reach the end of their lifespan. In the conventional paper feeding unit, the abrasion of the rollers occurs quickly due to the above-described reasons. Therefore, parts must be replaced quite frequently.

Also, the paper feeding unit of the conventional image forming apparatus presses the paper while the first feed roller 3 and the reverse roller 4 are in contact with each other to have a nipping power. Therefore, the second feed rollers 5 should have a feeding power higher than the pressure of the first feed roller 3 and the reverse feed roller 4 when the paper is fed by the second feed rollers 5. Since this requires high-torque operation power, it results in cost increases.

SUMMARY OF THE INVENTION

The present general inventive concept provides a paper feeding unit of an image forming apparatus that can extend the part replacement period of rollers and related parts by suppressing the abrasion of a feed roller and/or a reverse roller.

The present general inventive concept also provides a paper feeding unit of an image forming apparatus that feeds paper fed by a second feed roller smoothly by separating a reverse roller and the feed roller after paper is separated into individual sheets by the reverse roller.

The present general inventive concept also provides an image forming apparatus incorporating an improved paper feeding unit.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are substantially realized by providing a paper feeding unit of an image forming apparatus, which includes a pickup roller to pick up paper accommodated in a paper feeding cassette,a first feed roller to feed the picked up paper in a required direction, and a reverse roller to prevent a plurality of sheets of paper from being fed by rotating in an opposite direction to a rotation direction of the first feed roller and to separate the paper into individual sheets of paper, wherein the first feed roller has a contact section to contact the reverse roller to feed and separate paper, and a non-contact section to cause the first feed roller to be separated from the reverse roller, and wherein the first feed roller feeds the paper by making a one-time rotation at a paper entering time point and stops rotating with the non-contact section facing the reverse roller.

The paper feeding unit may further include at least one second feed roller unit downstream of the first feed roller, wherein a length of the contact section of the first feed roller is longer than a distance from the first feed roller to the second feed roller.

The first feed roller may stop rotating when an edge of the paper fed by the contact section enters the second feed roller unit by more than a predetermined length.

The paper feeding unit may further include a rotation controlling unit to operate the first feed roller to rotate at the paper entering time point and to control the first feed roller to stop rotating at a time point when the first feed roller makes a one-time rotation and the non-contact section faces the reverse roller.

The rotation controlling unit may be formed of a solenoid or an electronic clutch.

The foregoing and/or other aspects and advantages of the present general inventive concept are also substantially realized by providing an image forming apparatus, which includes a paper feeding cassette to accommodate paper, a paper feeding unit to separate the paper from the paper feeding cassette into individual sheets of paper and to feed an individual sheet of paper, a developing unit to form a predetermined toner image and to transcribe the toner image on the paper fed by the paper feeding unit, a fixing unit to fuse and fix the toner image transcribed on the paper, and a paper discharge unit to eject the paper printed with an image, wherein the paper feeding unit includes a pickup roller to pick up paper accommodated in a paper feeding cassette, a first feed roller to feed the picked up paper in a required direction, and a reverse roller to prevent a plurality of sheets of paper from being fed by rotating in an opposite direction to a rotation direction of the first feed roller and to separate the paper into individual sheets of paper, wherein the first feed roller comprises a contact section to contact the reverse roller to feed and separate paper and a non-contact section to cause the first feed roller to be separated from the reverse roller, and the first feed roller feeds the paper by making a one-time rotation at a paper entering time point and stops rotating with the non-contact section facing the reverse roller and goes into a waiting mode with the reverse roller separated from the first feed roller.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
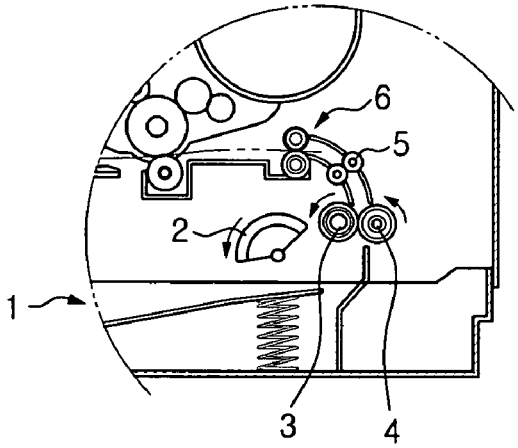
FIG. 1 (PRIOR ART)
FIG. 1 is a cross-sectional view showing a paper feeding unit of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. The matters defined in the description such as a detailed construction and elements are nothing but the ones provided to assist in a comprehensive understanding of the general inventive concept. Thus, it is apparent that the present general inventive concept can be carried out without those defined matters. Also, well-known functions or constructions are not described in detail since they would obscure the general inventive concept in unnecessary detail.

Figure 2:
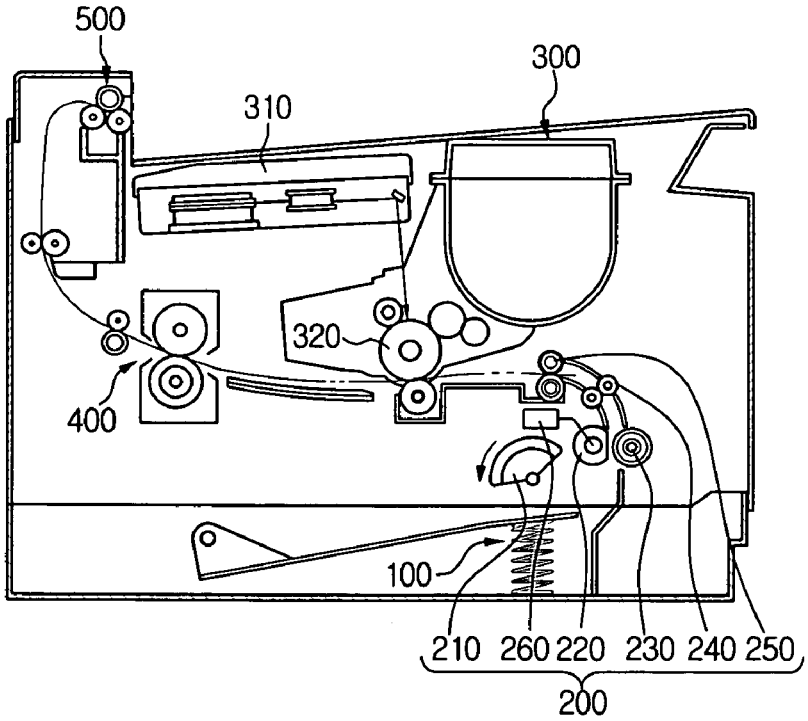
FIG. 2 is a cross-sectional view of an image forming apparatus having a paper feeding unit in accordance with an embodiment of the present general inventive concept.

As shown in FIG. 2, which presents a cross-sectional view of an image forming apparatus having a paper feeding unit in accordance with an embodiment of the present general inventive concept, the image forming apparatus includes a paper feeding cassette 100, a paper feeding unit 200, a developing unit 300, a fixing unit 400, and a paper discharge unit 500.

The paper feeding cassette 100 accommodates a plurality of sheets of paper, and the paper feeding unit 200 separates the paper in the paper feeding cassette 100 into individual sheets and sends each sheet of paper to the developing unit 300.

The paper feeding unit 200 includes a pickup roller 210, a first feed roller 220, a reverse roller 230, a second feed roller 240, a third feed roller 250, and a rotation controlling unit 260.

The pickup roller 210 picks up each sheet of paper accommodated in the paper feeding cassette 100 and supplies the paper to a paper feeding entrance in which the first feed roller 220 and the reverse roller 230 become engaged with each other to form a nip therebetween.

The first feed roller 220 supplies the paper picked up by the pickup roller 210 to the second feed roller unit 240 to thereby provide the paper to the developing unit 300 to be printed upon.

In accordance with an embodiment of the present general inventive concept, the first feed roller 220 can be repeatedly rotated and suspended by the rotation controlling unit 260, which is a solenoid or an electronic clutch. The first feed roller 220 rotates when the paper is picked up by the pickup roller 210 and makes an entrance between the reverse roller 230 and the first feed roller 220, and stops rotating when the paper enters the second feed roller unit 240.

Figure 3:
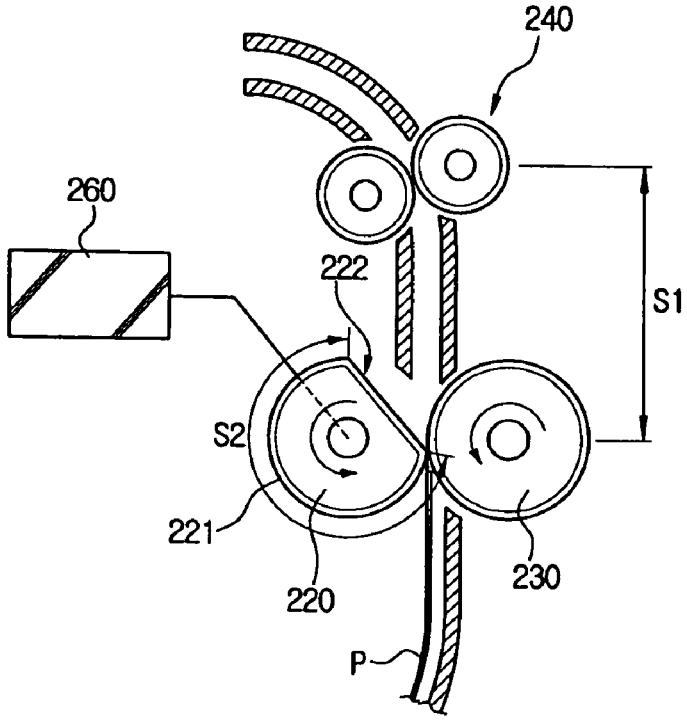
FIGS. 3 and 4 are cross-sections presenting enlarged views of a portion of the paper feeding unit of FIG. 2 during two different operational states.
Figure 4:
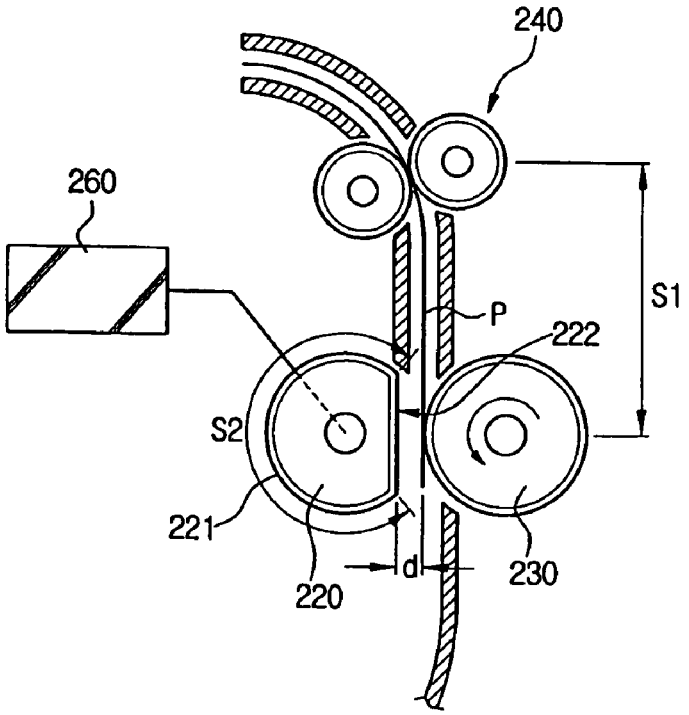

As shown in FIGS. 3 and 4, the first feed roller 220 has a contact section 221 and a non-contact section 222. The contact section 221 contacts the reverse roller 230 at a paper entering time point between the first feed roller 220 and the reverse roller 230 to thereby feed and separate the paper. The first feed roller 220 makes a one time rotation after the paper entering time point between the first feed roller 220 and the reverse roller. The non-contact section 222 separates the first feed roller 220 from the reverse roller 230 after the first feed roller 220 finishes feeding the paper through the nip formed between the contact section 221 and the reverse roller 230. The reverse roller 230, which contacts the contact section 221 of first feed roller 220 with a predetermined nipping power, rotates in the opposite direction to the rotation direction of the first feed roller 220, separates a plurality of sheets of paper which are picked up by the pickup roller 210, and sends excess paper back to the paper feeding cassette 100.

If the first feed roller 220 makes a one-time rotation, the non-contact section 222 comes to face the reverse roller 230, at which point the first feed roller 220 and the reverse roller 230 are apart from each other. Once the first feed roller 220 is apart from the reverse roller 230, the rotation of first feed roller 220 is stopped by the rotation controlling unit 260 and, as a result, the first feed roller 220 becomes separated from the reverse roller 230 and goes in a waiting mode.

Meanwhile, it is an aspect that a length (S2) of the contact section 221 of the first feed roller 220 is longer than a length (S1) of a portion of a paper feeding path between the second feed roller unit 240 and the reverse roller 230.

The reverse roller 230 is disposed on the paper feeding path between the pickup roller 210 and the second feed roller unit 240 and it rotates in an opposite direction to the rotation direction of the first feed roller 220. If the pickup roller 210 picks up a plurality of sheets of paper, the reverse roller 230 sends excess paper (all except one sheet) back to the paper feeding cassette 100, while the first feed roller 220 feeds the single sheet of paper along the paper feeding path in a paper feeding direction.

The reverse roller 230 prevents paper from being fed more than one sheet at a time by rotating in the opposite direction to the first feed roller 220 continuously while the image forming apparatus carries out a printing operation. That is, when the contact section 221 is in contact with the reverse roller 230, the reverse roller 230 separates the excess paper from the single sheet of paper with the first feed roller 220 by contacting the first feed roller 220 with a predetermined nipping power. When the non-contact section 222 is facing the reverse roller 230, it prevents excess paper from tagging along with the single sheet of paper (P) to be transported along the paper feeding route by continuing to rotate in the opposite direction to the paper feeding direction. This is because although the reverse roller 230 is separated from the first feed roller 220 when the non-contacting section 222 is facing the reverse roller 230, the separation distance (d) (see FIG. 4) is no more than several μm approximately, which corresponds to the thickness of the paper.

Therefore, although the reverse roller 230 continues to rotate in a reverse direction to separate the excess paper picked up during the operation of the image forming apparatus, the state of the first feed roller 220 is maintained by the rotation controlling unit 260 to make the non-contact section 222 face the reverse roller 230. Thus, the reverse roller 230 does not interfere in the normal feeding of the paper by the second feed roller unit 240.

The second and third feed roller units 240 and 250 are set up downstream of the first feed roller 220 and feed the paper (P) which is supplied one sheet at a time from the first feed roller 220 and the reverse feed roller 230 to the developing unit 300.

The developing unit 300 forms a toner image by supplying a developing agent to a photosensitive medium 320 with an electrostatic latent image formed therein by a laser scanning unit (LSU) 310 and transcribes the toner image on the paper (P).

The fixing unit 400 fuses and fixes the toner image on the paper (P) by applying a high temperature and a high pressure to the toner image formed by the developing unit 300.

The paper discharge unit 500 ejects the paper (P) completed with printing in the fixing unit 400 out of the image forming apparatus.

Hereafter, the operation of a paper feeding unit of an image forming apparatus suggested in the present general inventive concept will be described with reference to the accompanying FIGS. 2 through 4.

When printing begins, paper in a paper feeding cassette 100 is picked up by a pickup roller 210 and fed to a point where the first feed roller 220 and the reverse roller 230 become engaged with each other.

If a plurality of sheets of paper are picked up simultaneously, excess sheets of paper are separated from a single sheet to be fed and are sent back to the paper feeding cassette 100 by the reverse roller 230. That is, the first feed roller 220 feeds the picked up paper in a paper feeding direction. However, if a plurality of sheets of paper are picked up, one sheet of paper (P) in contact with the first feed roller 220 receives the rotation force of the first feed roller 220 and is fed to a second feed roller unit 240, and the other sheets of paper are separated from the one sheet (P) by contacting the reverse roller 230 that rotates in a direction opposite to the rotation direction of the first feed roller 220 and sent back to the paper feeding cassette 100.

As illustrated in FIG. 4, the first feed roller 220 makes a one-time rotation when an edge of the paper (P) enters the second feed roller unit 240. Since the length (S2) of the contact section 221 of the first feed roller 220 is longer than the distance (S1) from the first feed roller 220 to the second feed roller 240, if the paper (P) is fed as much as the length (S2) of the contact section 221, the edge of the supplied paper (P) can enter the second feed roller 240. Therefore, the paper being fed can be provided to the developing unit 300 by receiving the rotation power from the second feed roller unit 240.

As described above, if the first feed roller 220 makes a one-time rotation when the paper (P) enters between the reverse roller 230 and the first feed roller 220, the first feed roller 220 is stopped with its non-contact section 222 facing the reverse roller 230 by a rotation controlling unit 260. Thus, the first feed roller 220 and the reverse roller 230 become separated and therefore do not apply pressure to the paper (P) being fed.

While the rotation controlling unit 260 can be set up to control the rotation of the first feed roller 220 after the first feed roller 220 makes a one-time rotation, the present general inventive concept is not limited to this particular embodiment. That is, while the length (S2) of the contact section 221 is formed to be equal to or longer than the range (S1) of the paper feeding route, it is possible to set up the rotation controlling unit 260 to stop the first feed roller 220 when the paper (P) enters the second feed roller unit 240 more than a predetermined length.

If the pickup roller 210 picks up another sheet of paper (P) in the paper feeding cassette 100, the first feed roller 220 is controlled by the rotation controlling unit 260 to contact the reverse roller 230 at the beginning part of the contact section 221, and begins rotating to thereby execute the paper separation with the reverse roller 230, which is described above.

In the operation where the second feed roller unit 240 feeds the paper (P), if the first feed roller 220 is separated from the reverse roller 230, the paper (P) being fed to the developing unit 300 is not in simultaneous contact with both the first feed roller 220 and the reverse roller 230. Therefore, the paper is not chafed against the reverse roller 230, and thus the reverse roller 230 is protected from being worn out.

If the first feed roller 220 is separated from the reverse roller 230, the paper (P) can be supplied to the developing unit 300 without interference from the first feed roller 220 and the reverse roller 230. Therefore, the paper (P) can be fed smoothly. In addition, since the second feeding roller unit 240 and a third feeding roller unit 250 can feed the paper with less force, the operation can be executed with a low-torque operation power.

As described above, the technology of the present general inventive concept can extend the part replacement period of the paper feeding unit by reducing the abrasion of the feed roller and/or reverse roller.

Moreover, since the paper can be fed smoothly by the second feed rollers by separating the reverse roller and the feed roller after the separation of paper by the reverse roller, the feeding of the paper by the second feed roller is carried out smoothly, which reduces malfunctioning of the paper feeding unit.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper feeding unit of an image forming apparatus, comprising:

a pickup roller to pick up paper accommodated in a paper feeding cassette;

a first feed roller to feed the picked up paper in a required direction; and a reverse roller to prevent a plurality of sheets of the paper from being fed simultaneously by rotating in an opposite direction to a rotation direction of the first feed roller and to separate the paper into individual sheets of paper, wherein the first feed roller includes a contact section to contact the reverse roller to feed and separate paper, and a planar non-contact section to cause the first feed roller to be separated from the reverse roller and the paper, and the first feed roller feeds the paper by making a one-time rotation at a paper entering time point between the first feed roller and the reverse roller and stops rotating with the planar non-contact section facing the reverse roller.

2. The paper feeding unit as recited in claim 1, further comprising:

at least one second feed roller positioned downstream of the first feed roller, wherein a length of the contact section of the first feed roller is longer than a distance from the first feed roller to the second feed roller.

3. The paper feeding unit as recited in claim 2, wherein the first feed roller stops rotating when an edge of the paper fed by the contact section enters the second feed roller by more than a predetermined length.

4. The paper feeding unit as recited in claim 2, further comprising:

a rotation controlling unit to operate the first feed roller to rotate at the paper entering time point and to control the first feed roller to stop rotating at a time point when the first feed roller makes a one-time rotation and the non-contact section faces the reverse roller.

5. The paper feeding unit as recited in claim 4, wherein the rotation controlling unit includes a solenoid.

6. The paper feeding unit as recited in claim 4, wherein the rotation controlling unit includes an electronic clutch.

7. An image forming apparatus, comprising:

a paper feeding cassette to accommodate paper;

a paper feeding unit to separate the paper from the paper feeding cassette into individual sheets of paper and to feed an individual sheet of paper;

a developing unit to form a predetermined toner image and to transcribe the toner image on the paper fed by the paper feeding unit;

a fixing unit to fuse and fix the toner image transcribed on the paper; and a paper discharge unit to eject the paper printed with an image, wherein the paper feeding unit includes:

a pickup roller to pick up paper accommodated in a paper feeding cassette;

a first feed roller to feed the picked up paper in a required direction; and a reverse roller to prevent a plurality of sheets of paper from being fed by rotating in an opposite direction to a rotation direction of the first feed roller and to separate the paper into individual sheets of paper, wherein the first feed roller comprises a contact section to contact the reverse roller to feed and separate paper and a planar non-contact section to cause the first feed roller to be separated from the reverse roller and the paper, and wherein the first feed roller feeds the paper by making a one-time rotation at a paper entering time point between the first feed roller and reverse roller and stops rotating with the planar non-contact section facing the reverse roller and goes into a waiting mode with the reverse roller separated from the first feed roller.

8. The image forming apparatus as recited in claim 7, further comprising:

at least one second feed roller unit downstream with respect to the first feed roller, wherein a length of the contact section of the first feed roller is longer than a distance from the first feed roller to the second feed roller.

9. The image forming apparatus as recited in claim 8, wherein the first feed roller stops rotating when an edge of the paper fed by the contact section enters the second feed roller unit by more than a predetermined length.

10. The image forming apparatus as recited in claim 8, further comprising:

a rotation controlling unit to operate the first feed roller to rotate at the paper entering time point and to control the first feed roller to stop rotating at a time point when the first feed roller makes a one-time rotation and the non-contact section of the first feed roller faces the reverse roller.

11. The image forming apparatus as recited in claim 10, wherein the rotation controlling unit includes a solenoid.

12. The image forming apparatus as recited in claim 10, wherein the rotation controlling unit includes an electronic clutch.

13. A method of feeding paper in an image forming apparatus, comprising:

advancing sheets of paper into the image forming apparatus;

causing a radial surface portion of a first feed roller to contact a surface of a reverse roller when one or more of the sheets of advanced paper enter a point between the first feed roller and the reverse roller such that a single sheet of paper passes therebetween; and causing a planar non-radial surface portion of the first feed roller to be spaced apart from the reverse roller by a predetermined amount when the single sheet of paper exits the point between the first feed roller and the reverse roller.

14. The method as recited in claim 13, further comprising:

rotating a second feed roller downstream of the first feed roller to receive the single sheet of paper from the first feed roller, the second feed roller being a first distance from the first feed roller and a length of the radial surface feed portion of the first feed roller is longer than the first distance.

15. The method as recited in claim 13, further comprising stopping the first feed roller from rotating when an edge of the single sheet of paper fed by the radial surface portion enters the second feed roller by more than a predetermined length.

16. The method as recited in claim 13, further comprising:

operating the first feed roller to rotate when the advanced paper reaches the point between the first feeding roller and the reverse roller; and stopping the rotation of the first feed roller when the first feed roller makes a one-time rotation and the non-radial surface faces the reverse roller.

17. A method of feeding paper, comprising:

rotating a first feed roller in a first direction to feed a single sheet of paper in a first direction; and rotating a reverse roller in a second direction to move excess paper in a second direction, wherein a surface of the first feed roller is in contact with the reverse roller at a time when a sheet of paper is positioned between the first feed roller and the reverse roller and a planar surface of the first feed roller is separated from the reverse roller at a time when the sheet of paper exits the position between the first feed roller and the reverse roller.

18. A paper feeding unit of an image forming apparatus, comprising:

a first feed roller to feed paper in a required direction; and a reverse roller to prevent a plurality of sheets of the paper from being fed simultaneously by rotating in an opposite direction to a rotation direction of the first feed roller and to separate the paper into individual sheets of paper, wherein the first feed roller includes at least one planar non-contact section to reduce friction between the first feed roller and the reverse roller.

* * * * *